United States Patent [19]

Cairns

[11] Patent Number: 4,887,324

[45] Date of Patent: Dec. 19, 1989

[54] CURTAIN RETAINING APPARATUS

[76] Inventor: H. Ross Cairns, 2474 Sir Carodoc Lane, Mississauga, Ontario, Canada, L5K 2J6

[21] Appl. No.: 296,147

[22] Filed: Jan. 12, 1989

Related U.S. Application Data

[63] Continuation-in-part of Ser. No. 219,571, Jul. 15, 1988, abandoned.

[51] Int. Cl.[4] ..... A47K 3/22

[52] U.S. Cl. ..... 4/609; 24/487; 24/559; 160/349.2

[58] Field of Search ..... 4/607–610; 24/543, 487, 559; 248/205.3; 160/349.1, 349.2, 392, 395

[56] References Cited

U.S. PATENT DOCUMENTS

| | | | |
|---|---|---|---|
| 1,484,382 | 2/1924 | Allitt | 24/462 |
| 3,379,237 | 4/1968 | Worthington | 24/487 X |
| 3,700,019 | 10/1972 | Robbins et al. | 24/462 X |
| 3,879,806 | 4/1975 | Armstrong | 4/610 |
| 4,098,318 | 7/1978 | Ruegsegger | 160/349.2 X |
| 4,594,741 | 6/1986 | Payne | 4/608 X |
| 4,759,087 | 7/1988 | Zeilinger | 4/608 X |

FOREIGN PATENT DOCUMENTS

| | | | |
|---|---|---|---|
| 90167 | 3/1961 | Denmark | 24/462 |

*Primary Examiner*—Charles E. Phillips

*Attorney, Agent, or Firm*—Shoemaker and Mattare, Ltd.

[57] ABSTRACT

A one-piece molding grips a shower curtain by locking a marginal portion of the curtain between a rib on one arm and a groove on a second arm. The arms are swingable about a third arm through living hinges, and the first arm is adapted to be affixed against a wall of a shower enclosure. The shower curtain is pressed against the wall by one of the arms.

8 Claims, 4 Drawing Sheets

CURTAIN RETAINING APPARATUS

This is a continuation-in-part of U.S. patent application Ser. No. 219,571, filed July 15, 1988 now abandoned.

This invention relates generally to retaining members for curtains, and has to do particularly with a retaining system adapted to hold one vertical edge of a shower curtain against the wall of a shower stall.

BACKGROUND OF THIS INVENTION

A typical full bathroom, including a bathtub, normally has the shower head located above the control taps for the tub, and includes a water-impervious curtain on a track or rod, the purpose of which is to prevent shower water from splashing out of the tub enclosure.

The prior art contains some attempts to secure one vertical edge of the shower curtain against the enclosure wall, in order to reduce the risk of splashing.

One conventional means of accomplishing this as shown in U.S. Pat. No. 3,365,684, issued Jan. 23, 1968 to Stemke et al. In the Stemke et al patent, individual magnets are incorporated at spaced intervals into the curtain edge, and interact with corresponding members on the wall.

A further pertinent patent is U.S. Pat. No. 4,759,087, issued July 26, 1988 to A. Zeilinger. In this patent, a wall-attachment strip is adhesively bonded to a vertical wall, and a curtain attachment clip adapted to be fastened to an edge of the shower curtain can interlock with the wall attachment strip.

U.S. Pat. No. 3,000,016, issued Sept. 19, 1961 to S. A. Ridge, shows a means for securing the bottom edge of a shower curtain against a ferromagnetic cast bathtub.

A particularly pertinent patent is U.S. Pat. No. 4,594,741, issued June 17, 1986 to A. L. Payne. In the Payne patent, a C-shaped clip member secures an edge of the curtain to a ferromagnetic member, the latter being adapted to adhere magnetically to a magnetic strip placed on the wall.

A further patent of interest is U.S. Pat. No. 2,212,326, issued Aug. 20, 1940 to Piken.

The foregoing patents describe structures that are either overly complex, or not capable of providing a neat and secure seal between the curtain and the wall.

GENERAL DESCRIPTION OF THIS INVENTION

Accordingly, this invention provides a one-piece clip for retaining shower curtains, the clip being of constant cross-section and comprising:

a first arm having two parallel edges, a second arm having two parallel edges, one of which is integrally connected by a living hinge to said first arm at one edge of the latter, the other edge of the first arm being free, a third arm having two parallel edges, one of which is integrally connected by a living hinge to the other edge of the second arm, the other edge of the third arm being free, one of said first and third arms having integral structure defining a groove adjacent the free edge thereof, the other of said first and third arms having integral structure defining a rib adjacent the free edge thereof, the rib being receivable and retainable in said groove with a shower curtain interposed between them, the third arm being constructed such that, when said rib engages said groove and the first arm is affixed to a flat wall surface, the free edge of the third arm terminates substantially at the wall surface.

GENERAL DESCRIPTION OF THE DRAWINGS

One embodiment of this invention, and three related structures, are illustrated in the accompanying drawings, in which like numerals denote like parts throughout the several views, and in which.

DETAILED DESCRIPTION OF THE DRAWINGS

Figure 1:
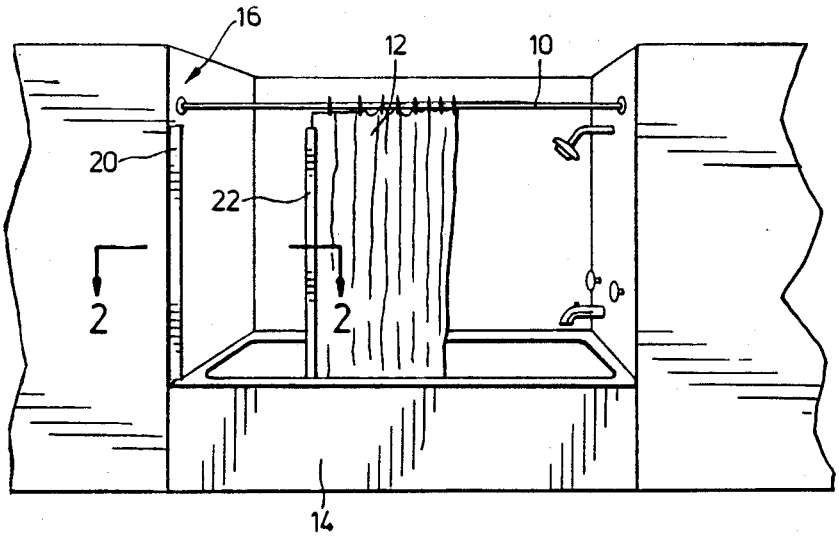
FIG. 1 is a perspective drawing of a typical bathtub installation, showing the location of components.

Attention is first directed to FIG. 1, which shows a typical bathtub installation, including a curtain rod 10, a shower curtain 12, and a tub 14. Standard fittings are shown at 15, and a shower head at 15*a*. At the outer corner 16 which is opposite the end having the fittings 15, there is secured an L-shaped strip 20, the section of which can best be seen in FIG. 2. In the embodiment illustrated, the strip 20 is of iron, although it could be of any other ferromagnetic material. The strip 20 may be adhered in place by double-sided tape. Alternatively, it could be secured by fasteners.

Figure 2:
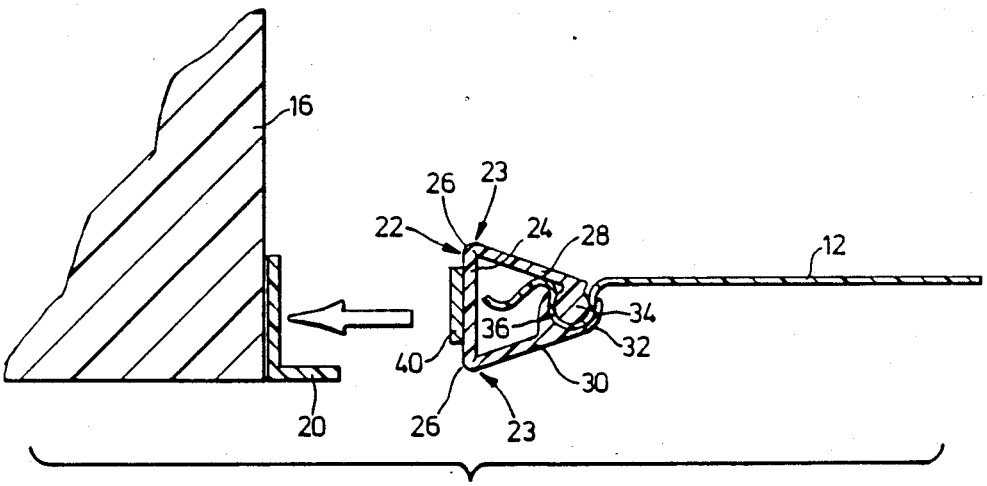
FIG. 2 is a horizontal sectional view taken at the line 2—2 in FIG. 1.

Looking simultaneously at FIGS. 1 and 2, it will be seen that the left-hand edge of the curtain 12 has adhered thereto a triangular molding 22 which is preferably made of polypropylene and is shaped to include two living hinges at 23.

More particularly, the one-piece molding 22 includes an elongate base portion 24 with opposed parallel edges 26, and two elongate arm portions 28 and 30, each arm portion 28, 30 being integrally connected by one of the living hinges 23 to a different one of the edges 26 of the base portion 24. Thus, the two arm portions 28 and 30 are swingable about their respective connections to the base portion 24, and are adapted to assume a position in which they converge toward each other, this position being shown in FIG. 2. The arm portion 30 is shaped to provide a groove 32, while the arm portion 28 is shaped to provide a rib 34 which is capable of being snapped into the groove 32 with a marginal portion 36 of the shower curtain 12 entrapped between the rib 34 and the groove 32.

In the structure shown in FIG. 2, a plurality of spaced strips 40 of magnetic material are affixed to the base portion 24 on the surface away from the arms 28 and 30. It will be evident upon inspecting FIG. 2 that the molding 22, and thus the marginal portion 36 of the shower curtain 12, is intended to be held against the strip 20 by the magnetic interaction between the strip 20 and the magnetic means 40. With regard to the latter, permanent magnets in the form of elongate strip material are well known. If desired, the item shown at 40 in FIG. 2 could consist of a plurality of short magnetic strips located at spaced-apart intervals along the base portion 24.

Figure 3:
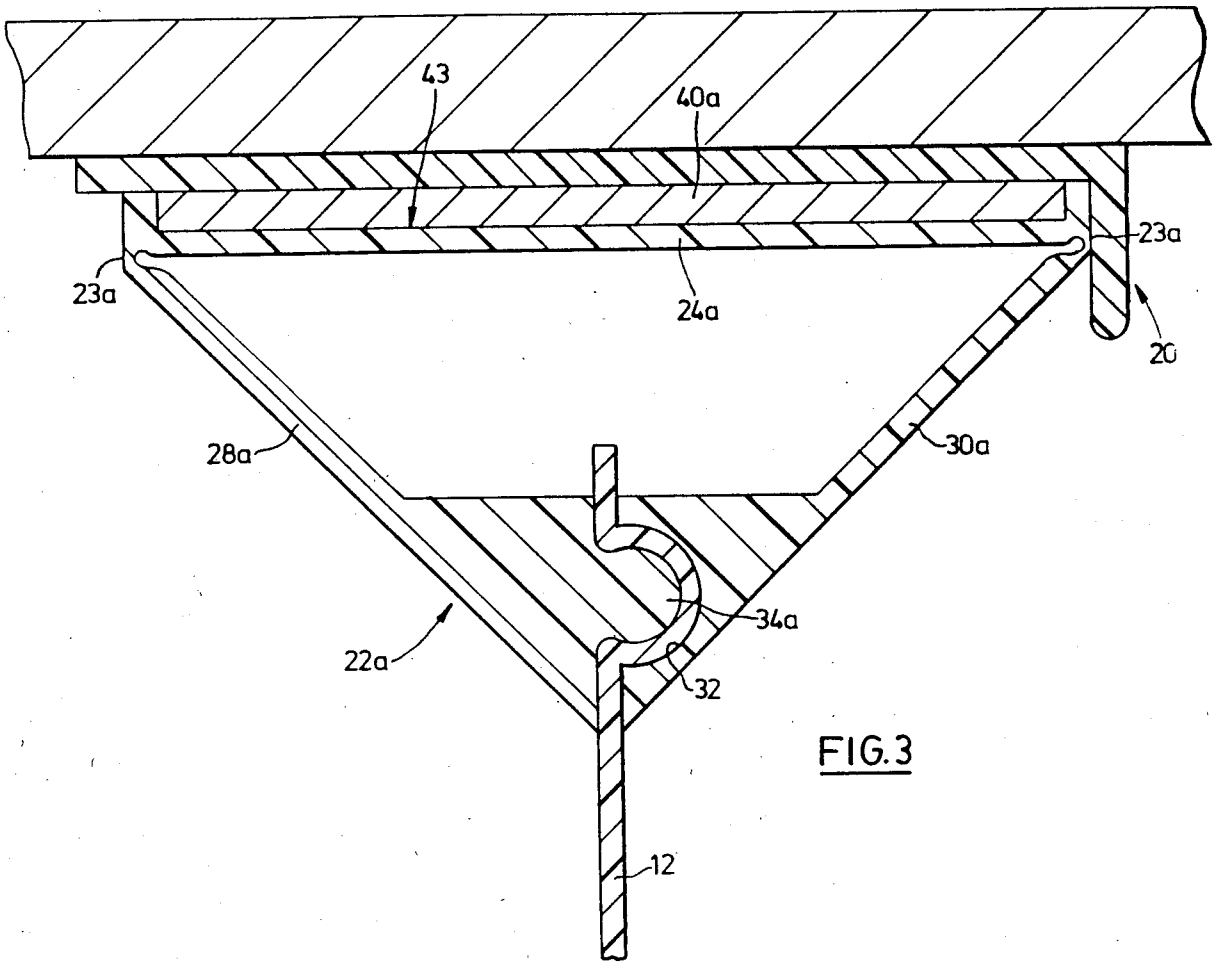
FIG. 3 is a horizontal section through another embodiment.

Attention is now directed to FIG. 3, which shows an alternative structure. In FIG. 3, the basic design of the one-piece molding 22a is very similar to that shown in FIG. 2. However, the base portion 24a in FIG. 3 is provided with a recess 43 into which one or more strips of magnetic material 40a can be positioned and adhered.

Corresponding portions in FIG. 3 have been given the same number as in FIG. 2, but with the subscript a.

Figure 4:
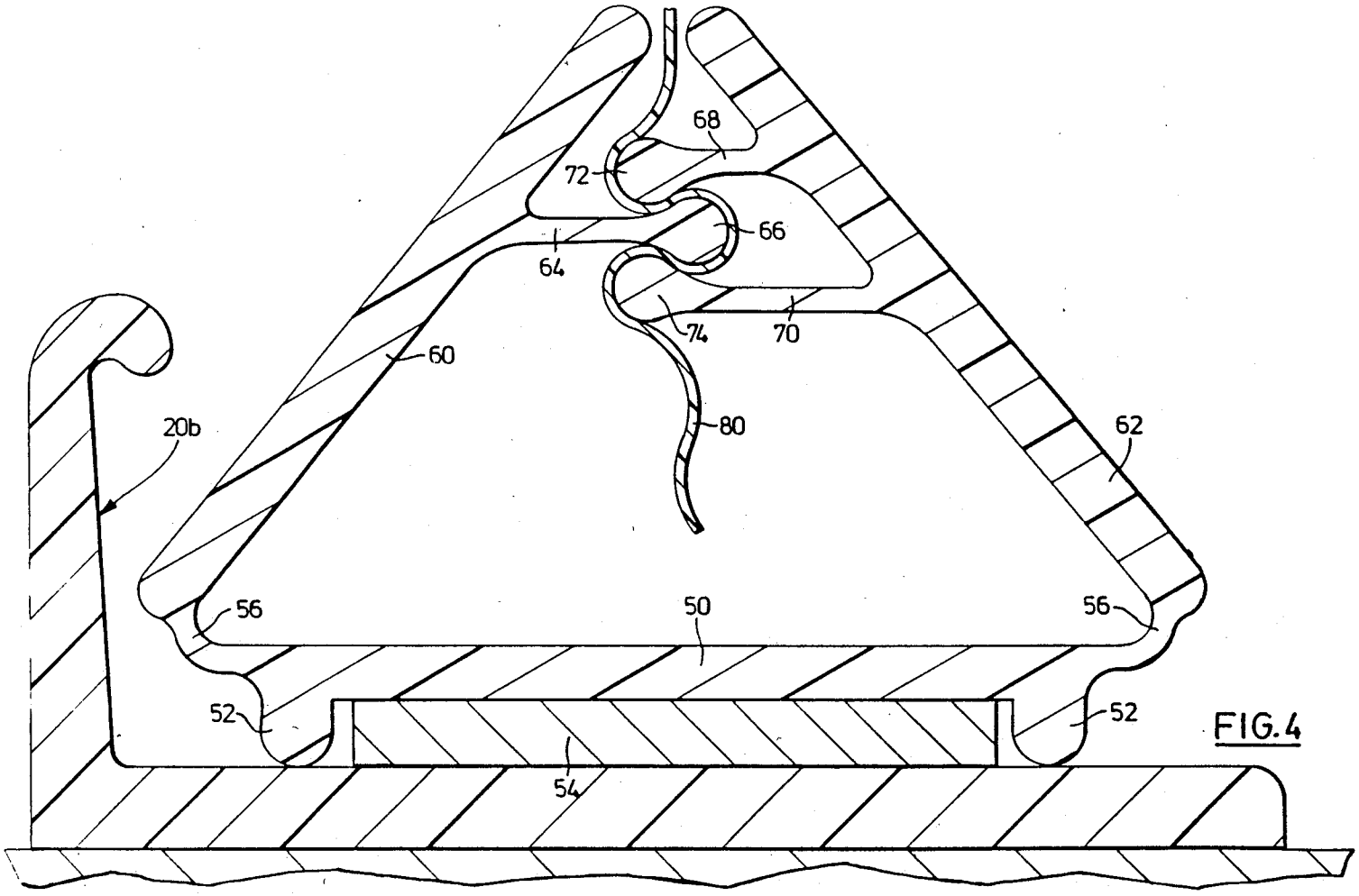
FIG. 4 is a horizontal sectional view through a further embodiment.

In FIG. 4, the structure illustrated includes a base portion 50, with ribs 52 running adjacent the edges, the ribs 52 being spaced-apart to allow an elongate member 54 to be secured to the base portion 50, the member 54 being either of magnetic material or of ferromagnetic material. At the edges of the base portion 50 there are provided integral living hinges 56 which connect the base portion 50 to two arm portions 60 and 62 respectively.

The arm portion 60 supports integrally a first flange 64 with an expanded bead 66 at the free end.

The other arm portion 62 supports two flanges 68 and 70, again each having an expanded bead 72, 74 respectively.

The flanges 64, 68 and 70 are somewhat flexible, thus allowing the bead 66 to be inserted between the beads 72 and 74, with a marginal portion 80 of the shower curtain trapped between the beads, as illustrated in FIG. 4.

The L-shaped strip 20b in FIG. 4 is substantially the same as the strip 20 shown in FIG. 3.

It will thus be recognized that the combination of the various portions provided herein will function to ensure leak-proof adhesion of the marginal portion 36 of a shower curtain 12 against a corresponding wall. This is particularly assured by the provision of the L-shaped strip 20.

The shape of the molding 22 is such that it can easily be injection molded or extruded. If injection molding is used, then the initial shape of the item, as molded, would typically have the arm portions 28 and 30 in a divergent configuration, i.e. diverging away from the base portion 24. The provision of the living hinges 23 would allow the arm portions to be swung in toward each other in order to grip the marginal edge of a shower curtain.

Those skilled in the art will immediately recognize that the magnetic means and the ferromagnetic means could be interchanged. In other words, a ferromagnetic strip of iron or the like could be adhered to the base portion 24, and a magnetic strip or strips could be adhered to the wall 16.

Figure 5:
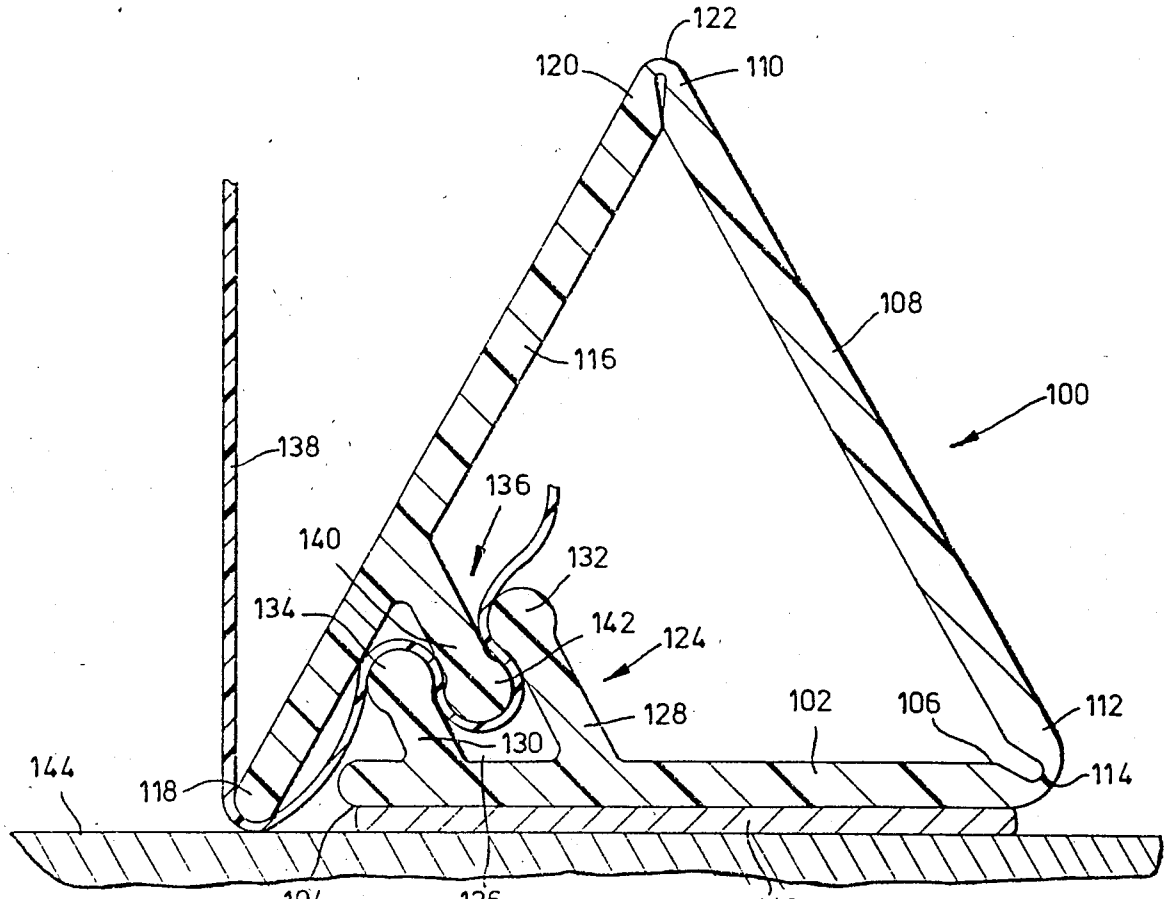
FIG. 5 is a horizontal sectional view through an embodiment of the invention to which this application is directed.

Attention is now directed to FIG. 5, which shows in cross-section the embodiment to which the present application is directed. FIG. 5 shows a one-piece clip 100 for retaining shower curtains. The clip has a constant cross-section which includes a first flat arm 102 with two parallel edges 104 and 106. The arm 102 is substantially flat between the edges 104 and 106.

A second arm 108 has two parallel edges 110 and 112, the edge 112 being connected by a living hinge 114 to the edge 106 of the first arm 102. It will be noted that the edge 104 of the first arm 102 is free, i.e. not connected to any other arm.

A third arm 116 is provided, having two parallel edges 118 and 120. The edge 120 is integrally connected by a living hinge 122 to the edge 110 of the second arm of 108. As can be seen in FIG. 5, the other edge 118 of the arm 116 is free, i.e. not connected to any other arm.

The arm 102 has at 124 an integral structure defining a groove 126 adjacent the free edge 104. More particularly, the groove 126 is defined by a first flange 128 and a second flange 130 spaced away from the flange 128, each of the flanges 128 and 130 having a bead, 132 and 134 respectively, at their edges remote from the arm 102. The third arm 116 has an integral structure 134 defining a rib adjacent the free edge 118, the rib being receivable and retainable in the groove 126, with a shower curtain 138 interposed between them. More particularly, the structure 136 includes a flange 140 having a bead 142 at its edge remote from the arm 116.

It will be noted in FIG. 5 that the edge of the shower curtain 138 is trapped in the groove 126 by virtue of bending around the bead 134, under the bead 142, and again partly around the bead 132.

The one-piece clip 100 shown in FIG. 5 is adhered against a surface 144 by virtue of a piece of two-sided tape 146 which adheres the first arm 102 against the surface 144.

It will be noted in FIG. 5 that, with the one-piece clip 100 adhered in place against the wall 144, and the edge of the shower curtain 138 entrapped by the rib and groove combination described earlier, the free edge 118 of the third arm 116 terminates substantially at the wall surface 144. This provides a neat and aesthetically pleasing appearance for the person using the shower. The one-piece clip 100 shown in FIG. 5 can be placed on the inside or on the outside of a shower curtain, as the user may wish.

It will be noted that, in the particular embodiment illustrated in FIG. 5, the three arms, 102, 108 and 116 of the clip define substantially an equilateral triangle with all three arms having substantially the same width (except that the arm 116 is somewhat longer than the other two, in order to terminate adjacent a surface 144 against which the clip is adhered by the tape 146).

It is preferred that the clip shown in FIG. 5 be used in short pieces separated by a foot or more vertically along the shower enclosure. It has been found that it is not necessary to make the clip of FIG. 5 as a single elongate member. In its preferred form, the individual clips may have a length not greater than two inches.

While one embodiment of this invention has been illustrated in the accompanying drawings and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. A one-piece clip for retaining shower curtains, the clip being of constant cross-section and comprising:

a first arm having two parallel edges, a second arm having two parallel edges, one of which is integrally connected by a living hinge to said first arm at one edge of the latter, the other edge of the first arm being free, a third arm having two parallel edges, one of which is integrally connected by a living hinge to the other edge of the second arm, the other edge of the third arm being free, one of said first and third arms having integral structure defining a groove adjacent the free edge thereof, the other of said first and third arms having integral structure defining a rib adjacent the free edge thereof, the rib being receivable and retainable in said groove with a shower curtain interposed between them, the third arm being constructed such that, when said rib engages said groove with the plane of a shower curtain extending perpendicular to a wall surface and the first arm is affixed to said wall surface, the free edge of the third arm terminates substantially at said wall surface so as to position said shower curtain against said wall surface.

2. The clip claimed in claim 1, in which the groove is on the first arm and the rib is on the third arm.

3. The clip claimed in claim 2, in which, when said rib engages said groove, the clip in cross-section defines substantially an equilateral triangle with all three arms having substantially the same width.

4. The clip claimed in claim in combination with a piece of two-sided tape for adhering said first arm to a vertical wall surface.

5. The clip claimed in claim 4, in which the clip has a length less than 2 inches.

6. The clip claimed in claim 1, in which, when said rib engages said groove, the clip in cross-section defines substantially an equilateral triangle with all three arms having substantially the same width.

7. The clip claimed in claim 1, in combination with a piece of two-sided tape for adhering said first arm to a vertical wall surface.

8. The clip claimed in claim 1, in which the clip has a length less than 2 inches.

* * * * *